US005355702A

United States Patent [19]

Escribens

[11] Patent Number: 5,355,702

[45] Date of Patent: Oct. 18, 1994

[54] SECURITY COMBINATION KEY

[76] Inventor: Augusto Escribens, Dellepiani 779, San Isidro, Lima 27, Peru

[21] Appl. No.: 130,678

[22] Filed: Oct. 4, 1993

[51] Int. Cl.[5] ..... E05B 19/18

[52] U.S. Cl. ..... 70/395; 70/397; 70/398; 70/401; 70/411; 70/456 R

[58] Field of Search ..... 70/456 R, 394, 395, 70/397, 398, 400, 401, 408, 411, 409

[56] References Cited

U.S. PATENT DOCUMENTS

| | | | |
|---|---|---|---|
| 825,063 | 7/1906 | Lawbaugh | 70/456 R |
| 939,679 | 11/1909 | Freud | 70/411 |
| 947,132 | 2/1910 | Jenkins | 70/398 |
| 1,899,739 | 2/1933 | Von Mehren | 70/411 |
| 3,486,353 | 12/1969 | Pilvet | 70/398 |
| 3,672,192 | 6/1972 | Dontas | 70/456 R X |
| 3,808,853 | 5/1974 | Helenurm | 70/398 X |
| 3,827,151 | 8/1974 | Naill | 70/394 X |
| 3,991,596 | 11/1976 | Gartner | 70/303 A |
| 4,545,226 | 10/1985 | Urrestarazu-Borda | 70/398 X |
| 4,662,200 | 5/1987 | Borda | 70/398 X |
| 4,747,282 | 5/1988 | Nyun | 70/398 X |

FOREIGN PATENT DOCUMENTS 0377135 7/1990 European Pat. Off. ..... 70/411

*Primary Examiner*—Lloyd A. Gall
*Attorney, Agent, or Firm*—Richard L. Miller

[57] ABSTRACT

A security combination key is provided, which consists of a hollow housing having a removable cover plate. An elongated guide member having an open track therein and a ward groove on a side thereof, extends from one side of the hollow housing. A plurality of blades having serrations extend in parallel relationships from within the hollow housing into the track of the guide member with the serrations exposed in the track. An apparatus is for sliding the blades in the track of the guide member, to form various combinations with the serrations to match up with pin tumblers in specific locks. A device is for locking the blades in a stationary position in the track of the guide member. The guide member having the ward groove can be inserted into a keyway having a compatible set of ward ridges in a cylinder of the lock, allowing the serrations of the blades to properly position the pin tumblers to permit operation of the lock.

2 Claims, 2 Drawing Sheets

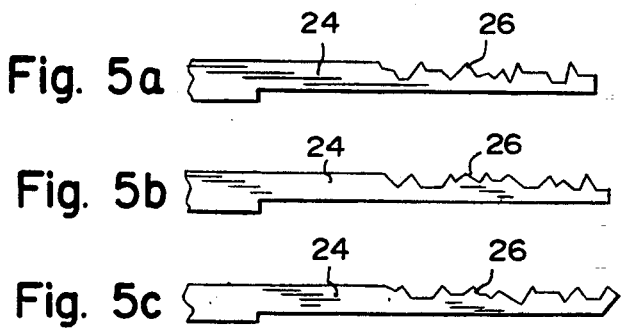
Fig. 5a
Fig. 5b
Fig. 5c
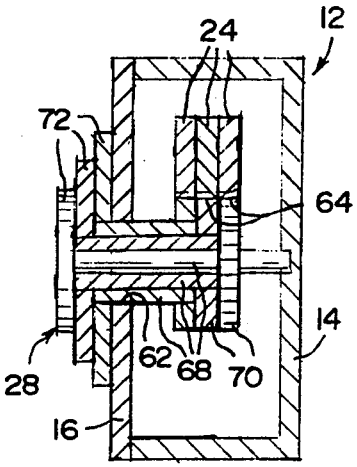
Fig. 7a
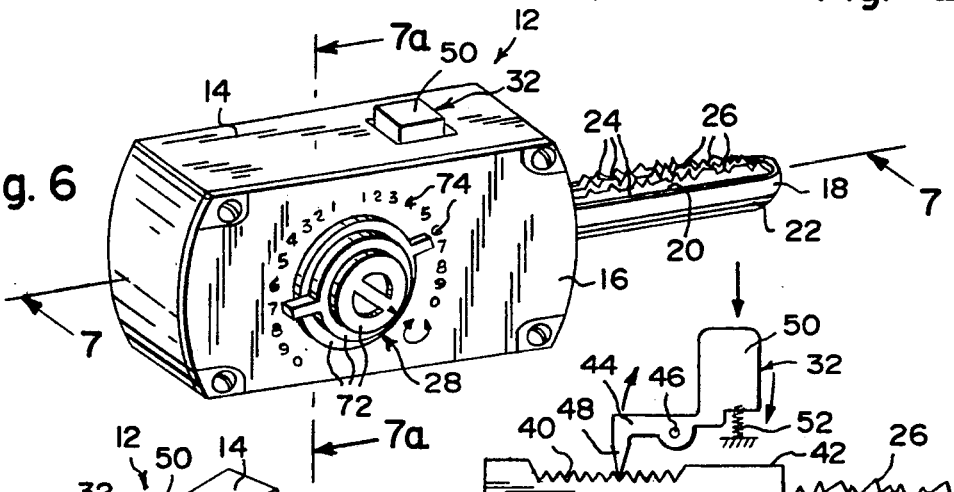
Fig. 6
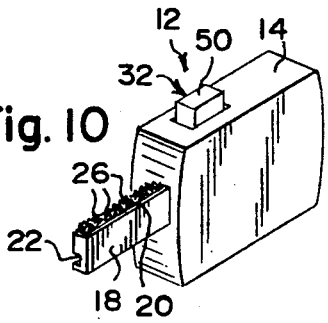
Fig. 10
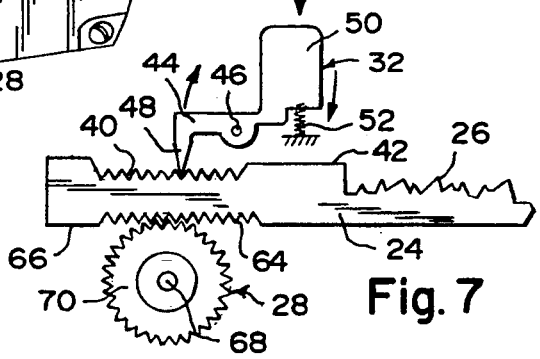
Fig. 7
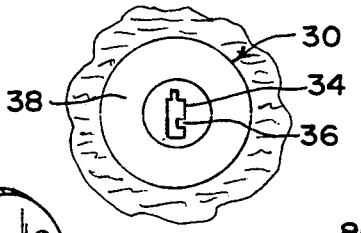
Fig. 11
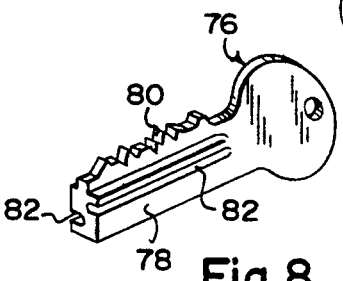
Fig. 8
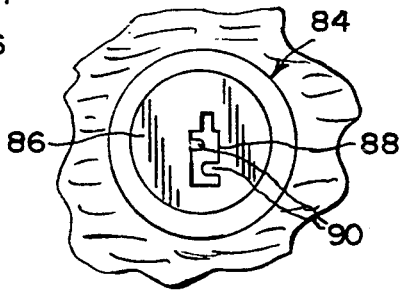
Fig. 9

SECURITY COMBINATION KEY

BACKGROUND OF THE INVENTION

The instant invention relates generally to combination keys and more specifically it relates to a security combination key.

Numerous combination keys have been provided in prior art that are adapted to open various different locks with a single key. For example, U.S. Pat. Nos. 3,991,596 to Gartner; 4,545,226 to Urrestarazu-Borda and 4,662,200 to Borda all are illustrative of such prior art. While these units may be suitable for the particular purpose to which they address, they would not be as suitable for the purposes of the present invention as heretofore described.

SUMMARY OF THE INVENTION

A primary object of the present invention is to provide a security combination key that will overcome the shortcomings of the prior art devices.

Another object is to provide a security combination key that will operate different locks, in which each one of the locks is set for one of the specific combinations made possible by sliding key blades.

An additional object is to provide a security combination key that can be set in a non-operative neutral combination position, so there will be no danger if it gets lost, since there are many possible combinations that can be made by the sliding key blades.

A further object is to provide a security combination key that is simple and easy to use.

A still further object is to provide a security combination key that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

Figure 1:
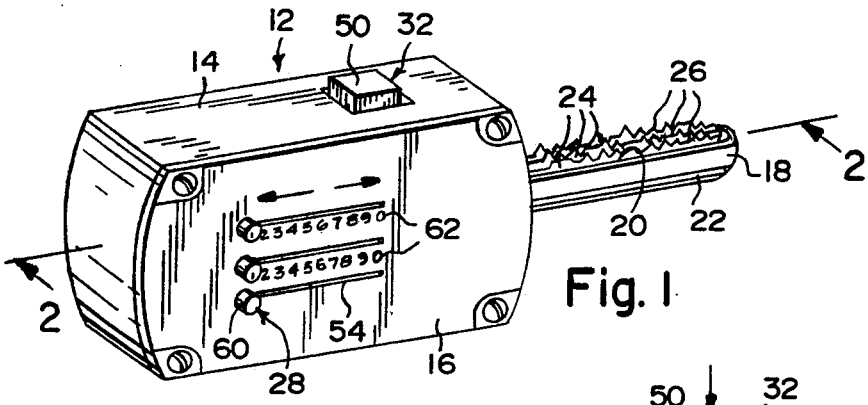
FIG. 1 is a diagrammatic perspective view of a first embodiment of the instant invention.
Figure 3:
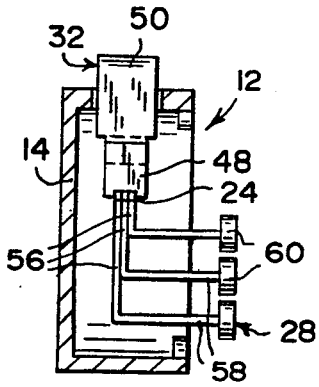
FIG. 3 is a cross sectional view taken on line 3—3 of FIG. 2.

FIGS. 5*a*, 5*b* and 5*c* illustrate typical individual key blades;

FIG. 6 is a diagrammatic perspective view of a second embodiment of the instant invention;

FIG. 7 is a diagrammatic cross sectional view taken on line 7—7 of FIG. 7 with parts broken away illustrating just a single key blade cooperating with an appropriate adjustment gear;

FIG. 7*a* is a diagramatic partial cross sectional view taken on line 7*a*—7*a* of FIG. 6;

FIG. 8 is a diagrammatic perspective view of a common key fabricated in such a matter as to be substituted with a specific combination, for a combination key of the instant invention;

FIG. 9 is a diagrammatic elevational view of a lock which would utilize the common key thereof;

FIG. 10 is a diagrammatic perspective view of the instant invention illustrating the key end of the instant invention; and FIG. 11 is a diagrammatic elevational view of a lock which would utilize the keys of the instant invention.

DETAILED DESCRIPTION OF THE PREFERRED EMBODIMENTS

Turning now descriptively to the drawings, in which similar reference characters denote similar elements throughout the several views, FIGS. 1 through 7*a* and 10 illustrate a security combination key 12, which consists of a hollow housing 14 having a removable cover plate 16. An elongated guide member 18 having an open track 20 therein and a ward groove 22 on a side thereof extends from one side of the hollow housing 14 to a distal tip of guide member. A plurality of blades 24 having serrations 26 extend in parallel relationships from within the hollow housing 14 into the track 20 of the guide member 18 with the serrations 26 exposed in the track 20. An apparatus 28 is for sliding the blades 24 in the track 20 of the guide member 18, to form various combinations with the serrations 26 to match up with pin tumblers in a lock 30 shown in FIG. 11. A device 32 is for locking the blades 24 stationary in the track 20 of the guide member 18. The ward groove 22 of the guide member 18 permits insertion of the security combination key 12, into a keyway 34, having a compatible set of ward ridges 36, allowing the serrations 26 of the blades 24 to properly position the pin tumblers to operate the lock 30.

Figure 2:
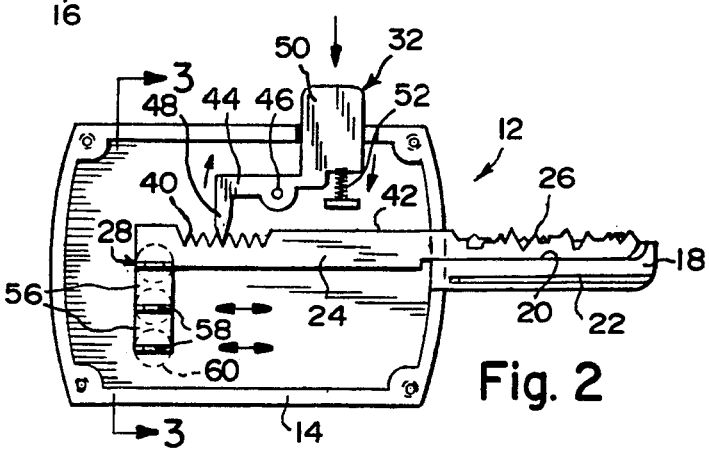
FIG. 2 is a cross sectional view taken on line 2—2 of FIG. 1.
Figure 4:
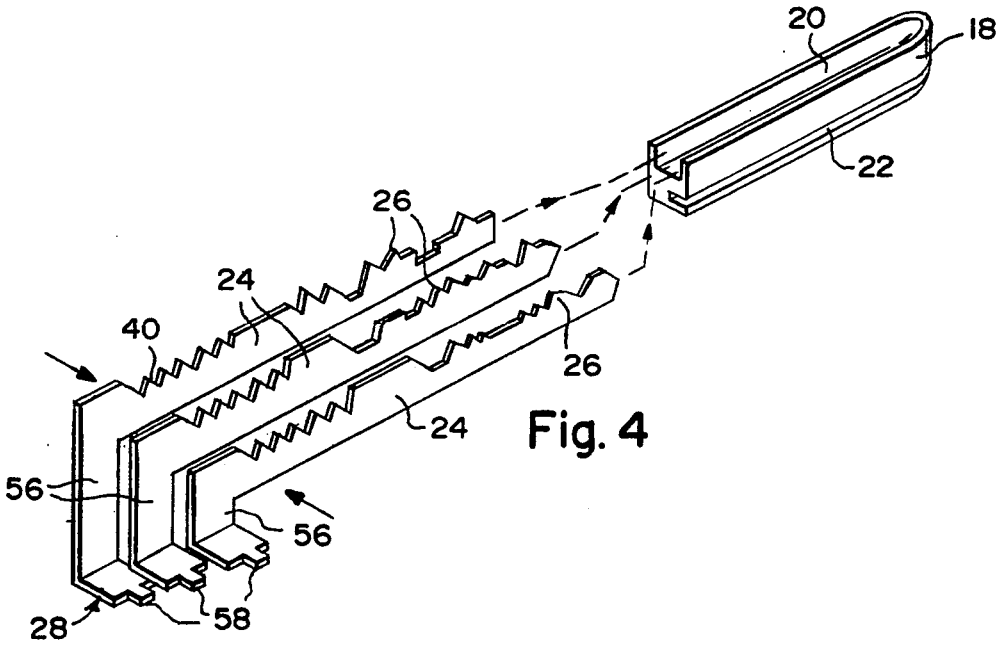
FIG. 4 is a diagrammatic exploded perspective view illustrating the separate key blades cooperating with each other to form various keys.

The locking device 32, as best seen in FIGS. 2 and 7, includes the blades 24 having a set of teeth 40 along one edge 42 thereof. A lever 44 is pivotally mounted at 46 within the hollow housing 14. A pawl 48 on a first end of the lever 44 extends inwardly towards the teeth 40 in the blades 24. A button 50 on a second end of the lever 44 extends outwardly through the hollow housing 14. A spring 52 is affixed between the lever 44 and a portion of the hollow housing 14, so as to bias the pawl 48 into the teeth 40 of the blades 24. When the button 50 is depressed, the pawl 48 will move away from the teeth 40 of the blades 24, to allow the blades 24 to slide.

The sliding apparatus 28 of the first embodiment, as shown in FIGS. 1, 2, 3 and 4 consists of the cover plate 16 having a plurality of parallel slots 54 therethrough. Each blade 24 has an L-shaped arm 56 bent at a right angle with an elongated handle 58 extending through one slot 54 in the cover plate 16. A plurality of knobs 60 are also provided, each knob 60 fits upon a distal end of one handle 58. Combination indicia 62 typically numbers or letters are printed on the cover plate 16 adjacent the slots 54. Each knob 60 can be moved along each slot 54 and set at one combination number 62.

The sliding apparatus 28 of the second embodiment, as shown in FIGS. 6, 7 and 7*a* consists of the cover plate 16 having an aperture 62 therethrough. Each blade 24 has a second set of teeth 64 along an opposite edge 66 thereof. A plurality of concentric shafts 68 extend through the aperture 62 in the cover plate 16 and are rotatively mounted within the hollow housing 14. A plurality of gears 70 are provided, with each affixed to one shaft 68 within the hollow housing 14, so as to engage with the second set of teeth 64 on each blade 24. A plurality of knobs 72 are also provided, with each affixed to one shaft 68 extending through the aperture 62 in the cover plate 16. Combination numbers 74 are printed on the cover plate 16 about the knobs 72, so that each knob 72 can be turned and set at one combination number 74.

FIG. 8 shows a common key 76 with a blade 78 having serrations 80 and two ward grooves 82 similar to the security combination key 12, so that it can in one instance be substituted for the security combination key 12. FIG. 9 shows a lock 84, with a cylinder 86 having a keyway 88 with two ward ridges 90. The key 76 in FIG. 8 is shaped so that it can be inserted into a conventional lock 84 or lock 30 which has only one ward ridge.

To use the security combination key 12, a person simply presses down the button 50 of the locking device 32. This will release the blades 24. The sliding apparatus 28 can now be manually operated by a person to set the serrations 26 in a proper combination to be received in the lock 30. The button 50 is now released and the guide member 18 with the blades 24 can be inserted into the keyway 34. The cylinder 38 is now turned to open the lock 30.

It is obvious that security combination key 12 permits a first user access to many locks with different combinations with just the one security combination key 12 assuming he knows the combination, while at the same time specific access can be given to a second user with the conventional key 76. In addition the first user can be denied access to a set of locks which requires two ward grooves.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A security combination key which will operate at least two different locks which comprises:

a) a hollow housing having a removable cover plate;

b) an elongated guide member having an open track therein and a ward groove on a side thereof, said guide member extending from one side of said hollow housing;

c) a plurality of blades having serrations, said blades extending in parallel relationships from within said hollow housing into said track of said guide member with said serrations exposed in said track;

d) means for sliding said blades in said track of said guide member to form various combinations with said serrations to match up with pin tumblers in a lock, wherein said means for sliding said blades includes:

i) said cover plate having a plurality of parallel slots therethrough;

ii) each said blade having an L-shaped arm bent at a right angle with an elongated handle extending through one said slot in said cover plate;

iii) a plurality of knobs, each to fit upon a distal end of one said handle; and iv) combination indicia printed on said cover plate adjacent said slots, so that each said knob can be moved along each said slot and set at one combination indicia; and e) means for locking said blades in a stationary position in said track of said guide member, so that said guide member having said ward groove can be inserted into a keyway having a compatible set of ward ridges in a cylinder of the lock, allowing said serrations of said blades to properly position the pin tumblers to permit operation of the lock, wherein said means for locking said blades includes:

i) said blades having a set of teeth along one edge thereof;

ii) a lever pivotally mounted within said hollow housing;

iii) a pawl on a first end of said lever extending inwardly towards said teeth in said blades;

iv) a button on a second end of said lever extending outwardly through said hollow housing; and v) a spring affixed between said lever and a portion of said hollow housing, so as to bias said pawl into said teeth of said blades, so that when said button is depressed said pawl will move away from said teeth of said blades to allow said blades to slide.

2. A security combination key which will operate at least two different locks which comprises:

a) a hollow housing having a removable cover plate;

b) an elongated guide member having an open track therein and a ward groove on a side thereof, said guide member extending from one side of said hollow housing;

c) a plurality of blades having serrations, said blades extending in parallel relationships from within said hollow housing into said track of said guide member with said serrations exposed in said track;

d) means for sliding said blades in said track of said guide member to form various combinations with said serrations to match up with pin tumblers in a lock, wherein said means for sliding said blades includes:

i) said cover plate having an aperture therethrough;

ii) each said blade having a set of teeth along an edge thereof;

iii) a plurality of concentric shafts extending through said aperture in said cover plate and rotatively mounted within said hollow housing;

iv) a plurality of gears each affixed to one said shaft within said hollow housing, so as to engage with said set of teeth on each said blade;

v) a plurality of knobs, each affixed to one said shaft extending through said aperture in said cover plate; and vi) combination indicia printed on said cover plate about said knobs, so that each said knob can be turned and set at one combination indicia; and e) means for locking said blades in a stationary position in said track of said guide member, so that said guide member having said ward groove can be inserted into a keyway having a compatible set of ward ridges in a cylinder of the lock, allowing said serrations of said blades to properly position the pin tumblers to permit operation of the lock, wherein said means for locking said blades includes:

i) said blades having a second set of teeth along an opposite edge thereof;

ii) a lever pivotally mounted within said hollow housing;

iii) a pawl on a first end of said lever extending inwardly towards said second set of teeth in said blades;

iv) a button on a second end of said lever extending outwardly through said hollow housing; and v) a spring affixed between said lever and a portion of said hollow housing, so as to bias said pawl into said second set of teeth of said blades, so that when said button is depressed said pawl will move away from said second set of teeth of said blades to allow said blades to slide.

* * * * *